United States Patent [19]

Walsh

[11] 4,366,407

[45] Dec. 28, 1982

[54] INCANDESCENT LAMP WITH SELECTIVE COLOR FILTER

[75] Inventor: Peter Walsh, Stirling, N.J.

[73] Assignee: Duro-Test Corporation, North Bergen, N.J.

[21] Appl. No.: 174,711

[22] Filed: Aug. 1, 1980

Related U.S. Application Data

[63] Continuation-in-part of Ser. No. 45,645, Jun. 5, 1979, which is a continuation of Ser. No. 863,155, Dec. 22, 1975, abandoned.

[51] Int. Cl.[3] ..... H01J 5/16

[52] U.S. Cl. ..... 313/112; 362/2; 362/255; 362/293

[58] Field of Search ..... 313/112; 362/2, 255, 362/293

[56] References Cited

U.S. PATENT DOCUMENTS 3,312,814 4/1967 Reading ..... 362/255

*Primary Examiner*—Stephen J. Lechert, Jr.
*Attorney, Agent, or Firm*—Darby & Darby

[57] ABSTRACT

An incandescent lamp utilizing a transparent heat mirror coating on the lamp envelope for transmitting radiation in a selected portion of the visible range to produce a desired color and reflecting infrared thermal radiation back to the filament for increasing its temperature and thereby increasing its efficiency. The coating is preferably of the etalon type having a layer of an insulating material sandwiched between two layers of metal.

20 Claims, 6 Drawing Figures

INCANDESCENT LAMP WITH SELECTIVE COLOR FILTER

This application is a continuation-in-part of my prior copending application Ser. No. 45,645, filed June 5, 1979, entitled "Incandescent Electric Lamp With Etalon Type Transparent Heat Mirror", which in turn is a continuation of application Ser. No. 863,155 filed Dec. 22, 1975, now abandoned, both of which are assigned to the same assignee.

The conventional incandescent lamps for producing light of a particular color, for example, red, blue or green, are generally of two types. The first uses a so-called absorptive filter in which the desired color is produced by filters placed external to the lamp or by a finish applied directly to the lamp envelope, usually on the outside. The filters have an absorptive action, that is, they absorb light energy in the unwanted portion of the spectrum which is transformed into heat for reradiation. Energy of the desired wavelength (color) is transmitted through the filter. These types of filters generally are of the organic type, e.g. paints, or possibly can be a silicon coating.

Another type of lamp for producing a selected color utilizes a multi-layer filter coating of a number of non-metallic films of low and high refractive indicies which are vaporized onto the glass envelope. Each layer of the coating is one-quarter ($\frac{1}{4}$) wavelength thick, resulting in high reflectance at that particular wavelength. Combinations of these materials and their thicknesses produce the desired spectral distribution of transmitted light. In general, such coatings are called "dichroic filters" and have as many as fifteen to twenty-one layers. Such lamps are disclosed, for example, in an article by Beesley entitled "New High-efficiency Color For PAR Lamps Using Multi-layer Interference Coatings" appearing in *Illuminating Engineering,* March 1964 (pages 208–212).

The present invention relates to an incandescent lamp for producing a desired color of visible light. The lamp utilizes a coating of a so-called etalon type in which a thin film layer of an insulating material is located between two thin film layers of a metal, the coating being called a composite metal-insulator-metal coating. The thin films of the coating are formed on the wall of the incandescent lamp envelope with the thickness of the individual films of the coating and their inter-relationships selected so as to maximize the coating transmission characteristics to energy produced by the filament for a wavelength of a particular color in the visible range. Also, the coating can be formed to maximize the reflecting properties to energy in the infrared range and, in conjunction with the envelope, to reflect the energy back to the filament to increase the efficiency of the lamp. The latter arrangement is described in the aforementioned copending patent application in which the coating transmits the major, if not the entire, portion of the visible spectrum produced by the incandescent filament. In addition, the present invention is capable of producing "white" light by the use of an etalon coating in which several transmission regions are selected.

It is therefore, an object of the present invention to provide an incandescent lamp for producing a desired color by use of an etalon coating.

An additional object is to provide an incandescent lamp for producing a selected color in the visible energy range having a composite metal-insulator-metal coating which transmits energy of the desired wavelength.

Another object is to provide an incandescent lamp for producing a selected color using an etalon coating which also reflects infrared energy back to the filament to increase the operating efficiency of the lamp.

A further object is to provide an incandescent lamp using an etalon coating for producing "white" light.

Other objects and advantages of the present invention will become more apparent upon reference to the following specification and annexed drawings in which.

GENERAL DESCRIPTION

Figure 1:
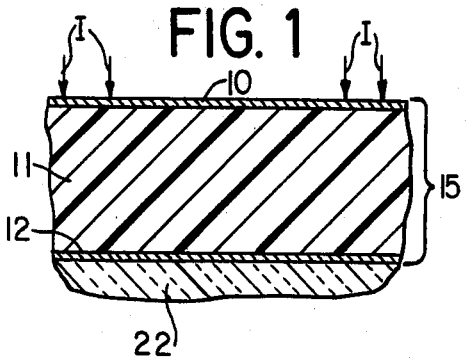
FIG. 1 is a side elevational view in section showing an etalon coating in accordance with the present invention.

FIG. 1 shows a fragment of a substrate 22, for example, an incandescent lamp envelope of lime glass, or PYREX, or other suitable glass, on which an etalon coating 15 is laid down. The particular type of glass is not critical. The etalon coating has three discrete thin film layers, which are shown greatly magnified and not to scale. The first of these is a thin film layer 12 of a reflecting, electrically conductive metal, such as silver, which is deposited on one surface of the substrate 22, a thin film layer of an insulating (dielectric) material 11, described below, which is deposited on the metal film layer 12 and an outer thin film layer 10 of a reflecting metal, which also can be the same as the first film 12, which is deposited on the insulating material 22. Any conventional and suitable techniques can be used for depositing the three film layers, some of these being, for example, chemical deposition, vapor deposition, sputtering, RF sputtering, etc.

The three film layers are preferably made separate and discrete from each other. That is, it is preferred that there be no interdiffusion of the materials of the layers. However, as described below, the film layers cooperate and are inter-related as a composite coating to produce the desired transmission and reflection characteristics and they are designed as a composite.

Incident radiation, shown by the arrow I, assumed to have components in the visible portion of the spectrum as well as energy in the infrared portion of the spectrum, is shown as impinging upon the layer 10 most remote from substrate 22. In accordance with the invention as described below, the coating transmits a maximum amount of energy in a particular region of the visible portion of the spectrum so as to produce a desired color, for example, green, blue, yellow, or "white", etc. In addition, the coating is preferably designed to reflect a maximum amount of energy in the longer wavelength range, including the infrared region.

Figure 2:
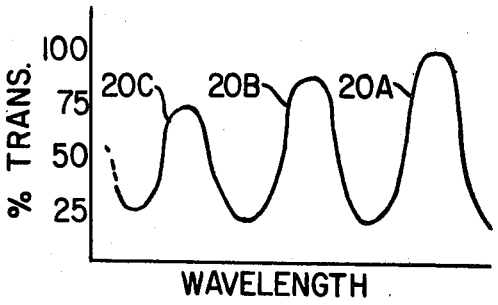
FIG. 2 is a diagram illustrating the response characteristics of etalon coating.

FIG. 2 shows a typical response curve for an etalon coating of the type shown in FIG. 1. The ordinate shows the transmission characteristic of the coating to incident radiation and the abscissa shows the wavelength. Characteristically, there are a number of energy transmission passbands, three being shown 20A, 20B, 20C, starting from longest wavelengths. The wavelengths of maximum transmission are integrally multiply related if the metal layers are thick. The etalon coating has a primary transmission pass band 20A at the longest wavelength, this shown as the third from the left and is designated $\lambda$. The next shorter wavelength is 20B and designated $\lambda/2$ and the shortest 20C is at $\lambda/3$. Shorter wavelengths approach the ultraviolet range and are damped off by the absorption of the glass. Some of the passbands 20 of FIG. 2 are in the visible range which cuts off at the upper end at about 80 nm (0.8 micron). If there is no passband in the infrared (IR) range, the coating will reflect IR energy. The etalon coating of the subject invention is designed to operate on one or more of the transmission passbands, depending upon the color to be produced, and to reflect the IR range energy.

In the design of etalon type coatings, the nature of the insulating film layer, that is, its index of refraction and thickness, controls the wavelength of the color output. The thickness of the metal films determines the special bandwidth, i.e., the sharpness at which the coating makes the transition from transparent to reflective at the desired wavelength. Also, the metal films provide the IR reflectivity while the insulator film provides phase matching for the metal films for transmission of the desired wavelength of light in the visible range.

Figure 3:
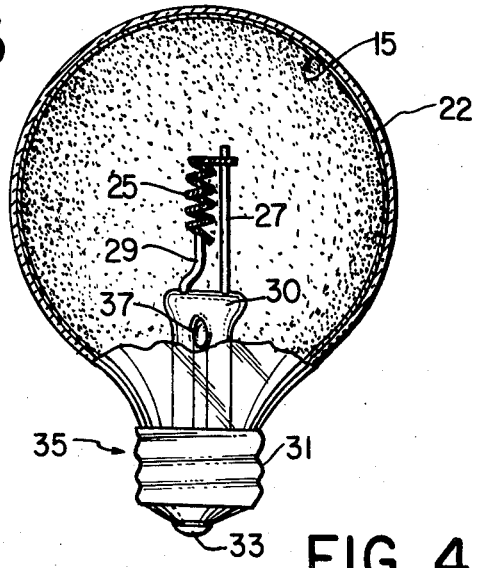
FIG. 3 is a view of an electric lamp in accordance with the invention.

FIG. 3 shows an incandescent lamp with etalon coating 15. The lamp includes the usual envelope 22 of a suitable glass material. The coating 15 is shown on the interior of the envelope although it can be placed on the outside. A filament 25, of a suitable material, such as plain or doped tungsten, is mounted on a pair of lead-in wires 27,29 held in an arbor, or stem, 30. The lead-in wires 27,29 are brought out through the arbor to electrical contacts 31,33 on a base 35. Arbor 30 also has a tubulation 37 through which the interior of the lamp is exhausted and filled, if desired, with a gas. Suitable gases are, for example, argon, argon-nitrogen, or a high molecular weight gas such as krypton.

When voltage is applied to the lamp, the filament incandesces and produces energy in both the visible and infrared range. The exact spectral distribution of the filament depends upon its operating temperature, which in turn depends upon the resistance of the filament. Typical filament operating temperatures are in the range of from about 2650° K. to about 2900° K. As the operating temperature decreases the spectral distribution shifts further to the red, i.e., it produces energy which is more into the infrared range.

The lamp described above is conventional in construction except for the coating 15 which, as described above, is to transmit a particular color. An example is described below wherein the coating is designed to transmit "blue" light.

It should be understood that conventional quarter wave theory, such as interference theory, is not used in the design of an etalon coating operating as disclosed. Conventional quarter wave theory, such as used in dichroic mirrors of the aforesaid Beesely article, considers phase changes induced by the non-metallic films the same as those in a thick metal film. For example, the phase change upon reflection from one metal layer of a dichroic type coating is taken in conventional quarter wave theory as 180°. In the thin metal films used in this invention, reflection and transmission phase changes depart from conventional quarter wave theory. Design of coatings according to quarter wave theory give composite filters which are inferior in the production of light of a desired color to the coatings of the subject invention. Further, the rapid rise in IR energy reflectivity displayed by the coating of the subject invention cannot be predicted by conventional quarter wave theory. In addition, conventional quarter wave theory demands a thickness of the dielectric layer which can, when employed in practice, places the peak in the transmission of light energy away from the portion of the visible wavelength region desired.

To design coating 15, referring to FIG. 1, let:

$n_0$=the index of refraction of the interior of the envelope. $n_0=1$ where the interior is air or a vacuum, and is close to 1 when it is a gas.

$\tilde{n}$=the index of refraction of each of the metal films 10 and 12. This has a real and an imaginary part such that $\tilde{n}=n-ik$. We assume $n<<k$.

$n_1$=the index of refraction of the dielectric film 11

$n_2$=the index of the glass envelope 22

$d_{10}$=the thickness of the film 10

$d_{12}$=the thickness of the film 12

$d_{11}$=the thickness of the dielectric film 11

$\phi_1=4\pi d_1 n_1/\lambda$ is the phase shift in the dielectric 11 at the wavelength $\lambda$.

$\alpha_{ij}=2\pi d_{ij}K$ is the damping factor of a metal film.

The intensity of reflectance of the etalon is:

$$R = \frac{R_{10} + R_{12} - 2\sqrt{R_{10}R_{12}}\cos\delta}{1 + R_{10}R_{12} - 2\sqrt{R_{10}R_{12}}\cos\delta}.$$

Here the individual film reflectance is:

$$R_{ij} = \frac{[(n_i - n_j)^2 + (K^2 + n_i^2 + n_j^2 + (n_i^2 n_j^2/K^2))\sinh^2\alpha_{ij}]}{4n_i n_j + [(n_i - n_j)^2 + (K^2 + n_i^2 + n_j^2 + (n_i^2 n_j^2/K^2))\sinh^2\alpha_{ij}]}$$

The etalon phase shift is:

$$\delta = \phi_{10} + \phi_{12} + \phi_1$$

with the phase shift upon reflection from a metal film as $$\phi_{ij} = \arctan\left\{\frac{-[2n_i K(K^2 + n_j^2)\cosh\alpha_{ij}\sinh\alpha_{ij}]}{-[(n_j^2 - n_i^2)K^2 + (K^2 - n_i^2)(K^2 + n_j^2)\sinh^2\alpha_{ij}]}\right\}$$

Commonly $\phi_{ij}$ lies between 180° and 360°. For a thick metal $\alpha_{ij}$ is large and $\phi_{ij}$ approaches 180°. Only then is conventional quarter wave theory applicable.

Minimum reflectance and maximum transmittance occur at $\delta=2\pi, 4\pi, \ldots$ This minimum reflectance has its smallest value, 0, when $R_{10}=R_{12}=R_f$. Under this condition, at any phase shift, $$1 - R = T + A = \frac{(1 - R_f)^2}{(1 - R_f)^2 + 4R_f\sin^2(\delta/2)}$$

where T and A are the transmittance and absorptance, respectively. The absorptance is small when $n << K$. Its calculation is straight forward but more complicated and requires the introduction of n into the calculations.

Figure 4:
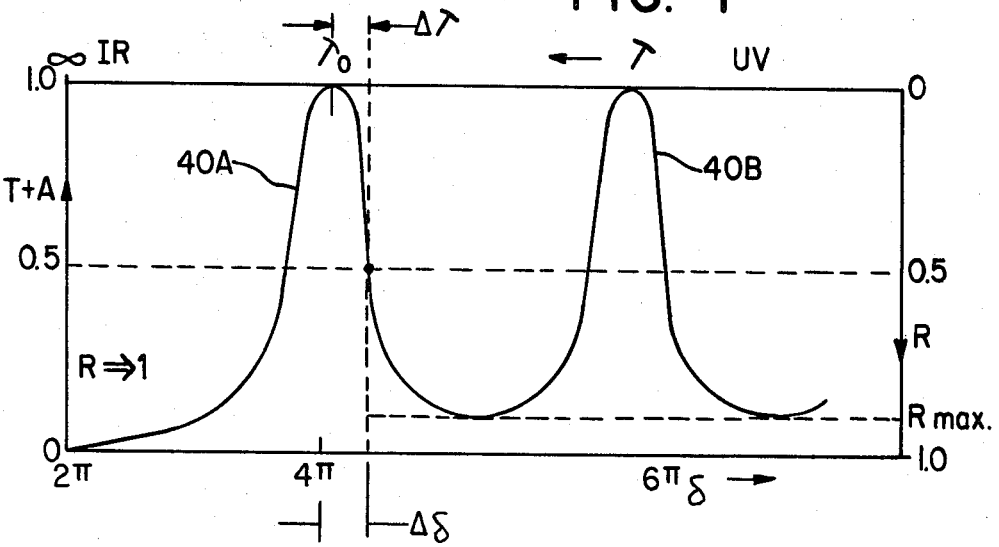
FIG. 4 is a schematic diagram showing the response characteristic of a preferred etalon coating utilizable with an incandescent electric lamp.

FIG. 4 illustrates the behavior of T+A versus $\delta$ as given by the above formula. The wavelength scale increases to the left and is not linear. The behavior of R at $\delta = 2\pi(\lambda = < \infty)$ is anomalous and is dominated by the fact that $R_{ij} = < 1$ rapidly at large wavelengths for metals. As expected the etalon is only reflective at very long wavelengths. The first and second peaks, 40A and 40B correspond respectively to the peaks 20A and 20B of FIG. 2.

When $R_{01} = R_{12}$, the peak in T+A is unity and R=0 at $\lambda_o$. With relatively thin metal films both the dielectric thickness and the metal thicknesses must be chosen together to given high transmission at a desired wavelength, $\lambda_o$. The half width of the filter is determined by a value of $\delta$ removed from $2\pi$, $4\pi$. . . by $\Delta\delta$ such that T+A=0.5. Thus, $$\frac{4R_f}{(1 - R_f)^2} \sin^2\left(\frac{\Delta\delta}{2}\right) = 1$$

If $\phi_{ij}$ does not change with wavelength, the one-sided wavelength half width is:

$$\Delta\lambda = \frac{\lambda_0}{\phi_1^0} \frac{|\Delta\delta|}{2}$$

where $\phi^{\circ}_1$ is the value of $\phi_1$ at $\lambda_o$. This equation can be used as a guide for determining the value of $R_f$ which will yield the half width desired. The condition of maximum transmission at $\lambda_o$ and desired bandwidth uniquely determine the metal and dielectric thicknesses.

As indicated, selection of a particular color by the filter is a function of $\lambda_o$ and $\Delta\lambda$. As $\Delta\lambda/\lambda_o$ becomes greater than 0.5, the selectivity of the filter will decrease, i.e., an amount of light of the next adjacent color will be passed by the filter. As $\Delta\lambda$ is decreased, the filter becomes more selective. The physical limitations of the filter do not permit it to become selective to a single wavelength, i.e., the filter will always pass a band of wavelengths.

Typical values of $\lambda_o$ and $\Delta\lambda(=0.5)$ for the primary colors are:

| | $\lambda_0$(nm) | $\Delta\lambda$(nm) |
|---|---|---|
| blue | 440 | 6 |
| green | 520 | 4 |
| red | 660 | 6 |

Using the foregoing equations, an etalon coating can be designed to transmit various colors. Typical examples using silver as the metal and a dielectric material having an index of refraction of about 1.38, which can be for example, magnesium fluoride, are given below. Values of n for silver were obtained from Johnson & Christy, Phys. Rev. B6, 4370 (1972).

Color of light to be transmitted: Blue
- Film 10 Silver—17.1 nm
- Film 11 Dielectric—98.0 nm
- Film 12 Silver—19.2 nm Color of light to be transmitted: Green
- Film 10 Silver—18.6 nm
- Film 11 Dielectric—130.0 nm
- Film 12 Silver—23.0 nm The design criteria used to achieve the above values is to pick the central wavelength, $\lambda_o$, of the color blue at about 44.0 nm with a wavelength band pass $\Delta\lambda = 6.0$ nm between and the wavelength at which R=0.5. The color green is centered at about 52.0 nm with a half width $\Delta\lambda = 4.0$ nm. In general it can be seen that the thicker dielectric film of the green etalon shifts the etalon bandpass from the blue spectral region to the green region while the slightly thicker overall metal results in a slightly narrower bandpass in the green region as compared to the blue region. Note that conventional quarter wave theory would place the central wavelengths at $nd_1/2$. This would incorrectly locate the central wavelength of the blue filter in the ultraviolet at about 270 nm and the green filter would be miscentered at about 369 nm.

The lamp of FIG. 3 can have further advantage of energy conservation if it is constructed such that the IR energy which is not transmitted through the coating is reflected back onto the filament to raise its operating temperature and thereby decrease the power (watts) needed to heat the filament to the temperature at which it incandesces. This can be done by shaping the envelope 22 as a reflector, e.g., by making it spherical, ellipsoidal, or other suitable optical shape, and centering the filament at the optical center of the envelope. The filament also can be located off-center by a predetermined amount and a similar but somewhat less efficient effect obtained. This is described in co-pending application Ser. No. 952,267, filed Oct. 18, 1978, now U.S. Pat. No. 4,249,101 granted Feb. 3, 1981 which is also assigned to the assignee.

The etalon film can be designed so that the passband characteristic toward higher wavelength is relatively broad. In this case, only a small amount of the IR energy is capable of being reflected by the coating. The non-reflected IR energy would be dissipated as heat through the coating and/or the envelope. If IR energy reflection is not to take place, it is not necessary to optically shape the envelope.

In the preferred embodiment of the invention, the metal of the etalon coating is silver. Silver has a high reflectivity to IR energy and also is relatively easy to work with. Further, silver when deposited in a thin film has relatively low absorption for energy in the visible light range. Other metals, such as for example, copper and gold, can be used, but have been found to be not as satisfactory.

The dielectric used between the metal layers can be almost any non-absorbing dielectric with a slight preference for low index of refraction dielectric. These can be deposited by evaporation, sputtering, as well as chemical deposition techniques. Suitable dielectrics are titanium dioxide, magnesium fluoride and cryolite.

In some viewing applications for a lamp having a color output, the output is preferably directional. A typical application would be, for example, in an advertising sign or a traffic light. To accomplish this, the previously described selective color producing lamps are coated on the inside with silver, or other material which is highly reflective to both light and IR energy, in the base half section.

Figure 5:
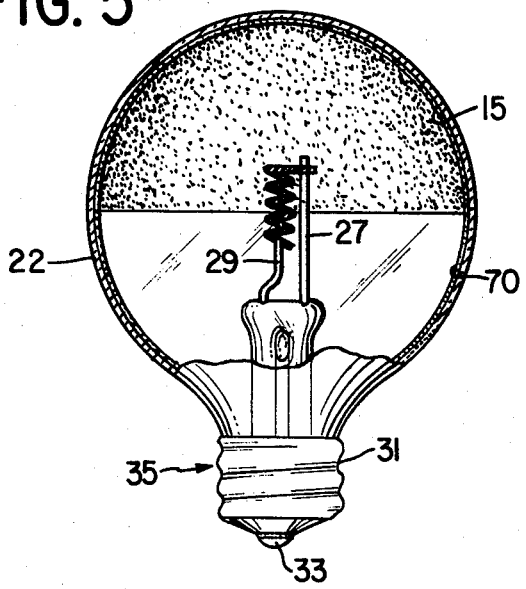
FIG. 5 is a diagram of a further embodiment of a lamp in accordance with the invention.

FIG. 5 shows a lamp utilizing this technique, as applied to the subject invention. Here, the lower half, or somewhat more, of the lamp envelope adjacent to the base is inside coated with a material 70, such as silver, which is highly reflective to both visible and IR energy.

The etalon color selective coating 15 is placed on the remaining portion of the envelope and operates as previously described. If the envelope of the lamp of FIG. 5 is optically shaped and the filament properly placed, the IR energy is reflected back to the filament not only from the etalon coating 15 but also from the other coating 70. As described previously, this raises the operating temperature of the filament and increases the lamp efficiency. It should be understood that if reflection of IR energy back to the filament is not required, then the envelope need not be optically shaped.

A lamp which transmits "white" light also can be produced. The color "white" is defined with its conventional meaning, i.e. the presence of a broad range of colors as, for example, found with a piece of white paper.

Figure 6:
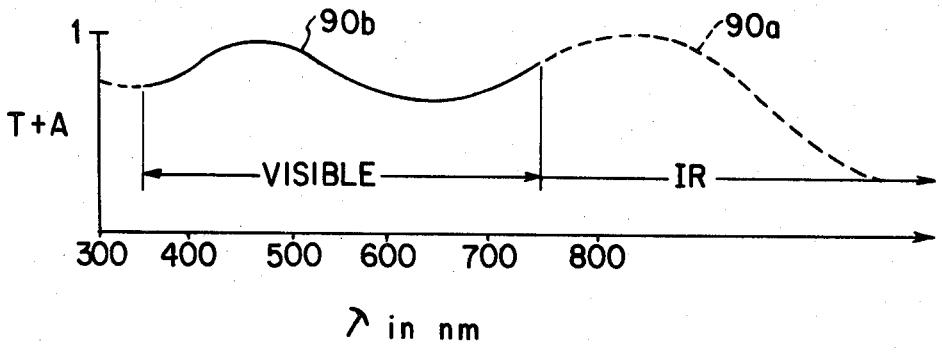
FIG. 6 is a diagram showing the characteristics of a coating for producing "white" light.

To accomplish this, a bluish filter is designed with widened bandpass characteristics such that the peak transmission of the passband of the selected blue filter falls on or close to the peak of the second passband encountered as the wavelength decreases from the infrared. Referring to FIG. 6, the first passband is 90*a*, which corresponds to passband 20A of FIG. 2. The white color filter requires a broad region of the whole visible spectrum with a peak in the blue region to compensate for the reddish hue from the filament output. This is accomplished by placing the second transmission passband 90*b* of the filter in the blue region, so that its first peak is in the near infrared red region, and then broadening the passbands. The overall passband of the filler is shown by curve.

The results of these considerations give rise to a coating which has a relatively thick insulator film, using magnesium fluoride as in the previous example, and a relatively thin silver film. Typical values for the coating films are:

10 dielectric—5.8 nm
11 silver—245.0 nm
12 dielectric—7.7 nm

The parameters given above are for a filter which has its first peak in the near IR region, at about 900 nm, with the second peak in the blue region at about 440 nm. The minimum of the transmission is at about 630 nm with the ratio of transmission at the second peak (440 nm) to that at the minimum (630 nm) being about 2.45:1. It should be understood that all of these values are typical and they can be varied to shift the color of the "white" light to make it more red or blue. As seen in FIG. 6, there is still substantial reflectivity to IR starting at about 1,000 nm and above.

The "white" filter of the invention produces an energy saving over an organic type coating used to produce white light because the coating is relatively less absorbing than common organic coatings. In addition, the high reflectivity in the middle IR produces additional energy savings due to IR reflected back to the filament.

The coatings described have relatively high reflectivity, i.e. 60% and above, to incident infrared energy. The coatings also have high transmissivity, generally also about 60% and above, to the selected color for which the coating is designed. The transmissivity of the coatings are considerably more efficient than the prior art organic coatings which, as previously described, only absorb and radiate heat omni-directionally and have no capability of reflecting infrared radiation.

As should be apparent, a novel incandescent lamp has been provided for producing predetermined colors of light by the use of a heat reflecting mirror of the etalon coating type. The coating is relatively simple to place on the lamp and can be placed on either the inside or the outside of the lamp envelope. The lamp also can be designed to have infrared energy produced by the filament reflected back to it, thereby increasing lamp efficiency.

I claim:

1. An incandescent electric lamp for producing visible light of a selected color region comprising:

an envelope of material which is transmissive to energy in the visible range, filament means within said envelope which incandesces in response to electrical current applied thereto to produce radiant energy in both the visible and infrared regions, means for supplying electrical current to said filament means, and a coating on said envelope formed of a discrete film of a dielectric material sandwiched between two discrete films of a metal, said films forming a composite filter for transmitting therethrough energy over only a selected portion of the visible range produced by said filament to provide a distinct color output for the lamp.

2. An incandescent lamp as in claim 1 wherein said coating is reflective to energy in the infrared range produced by said filament, said envelope being optically shaped and said filament means located with respect to said envelope such that infrared energy which impinges on the envelope is reflected back to the filament.

3. An incandescent lamp as in claim 1 wherein the two metal films of the coating are of unequal thickness.

4. An incandescent lamp as in claim 1 wherein the transmission characteristic of the coating has a plurality of bands each centered at a different wavelength, said coating transmitting visible light in a selected region located at the center $\lambda_o$ of the transmission band of longest wavelength with a transmission bandwidth of $\Delta\lambda$.

5. An incandescent lamp as in claim 3 wherein the transmission characteristic of the coating has a plurality of bands each centered at a different wavelength, said coating transmitting visible light in a selected region located at the center $\lambda_o$ of the transmission band of longest wavelength with a transmission bandwidth of $\Delta\lambda$.

6. An incandescent lamp as in claim 4 wherein $\Delta\lambda$ is defined on the longer wavelength side of the selected transmission band.

7. An incandescent lamp as in claim 5 wherein $\Delta\lambda$ is defined on the longer wavelength side of the selected transmission band.

8. An incandescent lamp as in either of claims 6 or 7 wherein $\Delta\lambda$ is the wavelength between $\lambda_o$ and the point of the selected transmission band where the transmission of the coating is approximately one-half that of its transmission at $\lambda_o$.

9. An incandescent lamp as in claim 8 wherein the transmission band of the coating is selected from the group of wavelengths in nanometers consisting of:

| $\lambda_0$ (about) | $\Delta\lambda$ (about) |
|---|---|
| 440 | 6 |
| 520 | 4 |
| 660 | 6 |

10. An incandescent lamp as in either of claims 1 or 3 wherein the transmission characteristic of the coating has a plurality of bands each centered at a different wavelength, said coating transmitting visible light in a selected wavelength region which spans two of said bands.

11. An incandescent lamp as in claim 10 wherein the peak of the longest wavelength band is in the infrared range and the peak of the other band is in the visible range.

12. An incandescent lamp as in claim 10 wherein the selected wavelength region is from the highest wavelength transmission band to the next lowest wavelength transmission.

13. An incandescent lamp as in claim 10 wherein the selected wavelength region transmits "white" light.

14. An incandescent lamp as in claim 11 wherein the peak of the other band occurs in the region of "blue" light and transmission of energy is continuous between the peaks of the first and second bands.

15. An incandescent lamp as in claim 14 wherein the transmission characteristic has a minimum in the visible range between the two peaks.

16. An incandescent lamp as in claim 4 wherein $\Delta\lambda$ is defined on the longer wavelength side of the selected transmission band.

17. An incandescent lamp as in claim 11 wherein the selected wavelength region is from the highest wavelength transmission band to the next lowest wavelength transmission.

18. An incandescent electric lamp as in either of claims 1 or 2 wherein the metal is selected from the group consisting of copper, gold and silver.

19. An incandescent electric lamp as in either of claims 1 or 2 wherein the dielectric material is selected from the group consisting of titanium dioxide, magnesium fluoride and cryolite.

20. An incandescent electric lamp as in claim 18 wherein the dielectric material is selected from the group consisting of titanium dioxide, magnesium fluoride and cryolite.

* * * * *